US006332581B1

(12) United States Patent
Chin et al.

(10) Patent No.: US 6,332,581 B1
(45) Date of Patent: Dec. 25, 2001

(54) ROTARY SPRINKLER NOZZLE

(75) Inventors: Douglas E. Chin, Chino Hills; Chad P. McCormick, Riverside, both of CA (US)

(73) Assignee: The Toro Company, Minneapolis, MN (US)

( * ) Notice: Subject to any disclaimer, the term of this patent is extended or adjusted under 35 U.S.C. 154(b) by 0 days.

(21) Appl. No.: 09/654,124

(22) Filed: Sep. 1, 2000

(51) Int. Cl.[7] ..... B05B 3/00

(52) U.S. Cl. ..... 239/246; 239/206; 239/231; 239/499; 239/521; 239/601; 239/DIG. 1

(58) Field of Search ..... 239/205, 206, 239/231, 246, 237, 543, 499, 518, 521, 248, 249, DIG. 1, 601, 590, 590.5, 553, 553.5, 548

(56) References Cited

U.S. PATENT DOCUMENTS

| | | | | |
|---|---|---|---|---|
| 3,149,784 | | 9/1964 | Skidgel . | |
| 3,645,451 | | 2/1972 | Hauser . | |
| 3,702,678 | | 11/1972 | Hauser . | |
| 3,716,192 | * | 2/1973 | Hunter | 239/205 |
| 3,794,245 | | 2/1974 | Wilson . | |
| 5,104,045 | | 4/1992 | Kah . | |
| 5,141,157 | * | 8/1992 | Han et al. | 239/206 X |
| 5,240,184 | | 8/1993 | Lawson . | |
| 5,299,742 | * | 4/1994 | Han | 239/246 X |
| 5,598,977 | | 2/1997 | Lemme . | |
| 5,642,861 | * | 7/1997 | Ogi et al. | 239/DIG. 1 |

* cited by examiner

*Primary Examiner*—Steven J. Ganey
(74) *Attorney, Agent, or Firm*—James W. Miller

(57) ABSTRACT

A sprinkler nozzle for a rotary sprinkler comprises two water flow passages extending therethrough, namely an upper passage and a parallel lower passage. The upper passage includes a straight, substantially cylindrical bore having stream straightening vanes, the upper passage watering radially outer portions of the watered pattern. The lower passage comprises a diffuser that reduces the energy of the water flowing into the lower passage by providing an expanded volume, namely a volume having a greater cross-sectional area than the cross-sectional area of the inlet. The water exits the diffuser through an outlet which includes a rear edge that forms an impact surface against which a portion of the boundary layer flow is directed. This impact surface is arch shaped and deflects the intercepted portion of the boundary layer flow from the top to the bottom of the lower passage. The boundary layer flow is then dumped onto a lower ramp of the outlet of the lower passage which lower ramp is downwardly inclined. The remaining water flowing through the lower passage bypasses the impact surface to exit through an upper arch of the outlet. Thus, the water exiting from the lower passage can water radially inner portions of the watered pattern while maintaining a substantially droplet form of water discharge even at medium to high water pressures.

23 Claims, 12 Drawing Sheets

ROTARY SPRINKLER NOZZLE

TECHNICAL FIELD

This invention relates to a nozzle for a rotary sprinkler which provides larger water droplet size at medium to high water pressures over the nozzle's radial reach.

BACKGROUND OF THE INVENTION

Rotary water sprinklers are known having a drive for rotating the sprinkler about an axis that is substantially vertical when the sprinkler is installed in its usual upright orientation. This type of sprinkler includes at least one nozzle that throws a stream of water as opposed to a spray or mist. The nozzle is set in one side of the sprinkler and is usually inclined upwardly relative to the surface to be watered. Thus, as the sprinkler rotates about a vertical axis, the water stream is thrown to one side of the sprinkler and rotates with the sprinkler to water an arc segment determined by the angular extent of the sprinkler's rotation.

One problem with this type of sprinkler is getting the water in the water stream to fall or precipitate out in areas close to the sprinkler. Typically, if water is thrown in a coherent stream at some trajectory relative to the surface to be watered, the stream will tend to water a doughnut shaped ring around the sprinkler with little water being deposited close to the sprinkler. This is obviously a disadvantage since the vegetation close to the sprinkler will be underwatered. One could perhaps compensate for this by increasing the length of time the sprinkler is allowed to run. However, this increases water usage and also means that the vegetation farther from the sprinkler in the radially outer portions of the pattern will then be overwatered if the vegetation close to the sprinkler is properly watered.

Some sprinklers use multiple nozzle passages in an attempt to solve this problem. These sprinklers have a first long range nozzle passage for watering radially outer portions of the pattern and a second short range nozzle passage for watering radially inner portions of the pattern. The long range nozzle passage is often larger in diameter and may be set at a higher trajectory angle than the short range nozzle passage. U.S. Pat. No. 3,645,451 to Hauser shows a rotary sprinkler with a long range/short range nozzle passage configuration of this type.

Unfortunately, even if one uses a short range nozzle passage, one must still get the water to evenly fall or precipitate out of the water stream being ejected by that nozzle passage to evenly water the radially inner portions of the pattern. Thus, the problem described above, namely of underwatering those areas closest to the sprinkler, still exists with respect to a short range nozzle passage. Moreover, one cannot simply unduly lower the trajectory of the short range nozzle passage to point it at areas adjacent the ground as the short range nozzle passage is also responsible for watering some of the intermediate portions of the pattern as well as the areas closest to the sprinkler. In addition, pointing a nozzle passage directly at the ground is not desirable since the water stream could impact the ground with too much force, thus damaging or destroying the turf or vegetation which it was designed to water.

The long range/short range nozzle passage combination described above has been further refined by attempting to break up the water flowing in the short range nozzle passage. U.S. Pat. No. 3,794,245 to Wilson shows an upwardly extending finger placed adjacent the outlet of the short range nozzle passage for moderately breaking up the water exiting from the short range nozzle passage "for providing water delivery to the ground areas close to (the sprinkler) head". Similarly, U.S. Pat. No. 5,104,045 shows various ways of attempting to get close in coverage by a nozzle passage by deflecting the short range nozzle stream and impacting such deflected stream against various surfaces, or by impacting multiple short range nozzle streams with one another.

While breaking up the water flowing in a short range nozzle passage may improve water distribution close to the sprinkler, it creates other problems. For example, when medium to high water pressure, e.g. in the range of 50–80 psi, is sent through a nozzle, impacting water at this pressure against a break up finger or against a surface will often change much, if not all, of the stream to a spray or mist. The stream is no longer in substantially droplet form. A spray or mist is easily blown by the wind so that it may never reach the areas close to the sprinkler. Thus, at higher water pressures, those nozzles attempting to break up the water intended to reach close to the sprinkler end up also creating an undesirable spray or mist rather than having the water precipitate or fall out of the stream in droplet form.

SUMMARY OF THE INVENTION

One aspect of this invention relates to a nozzle for a rotary sprinkler of the type having a nozzle base that is rotated by a drive. The nozzle comprises a nozzle body configured to be carried by the nozzle base for rotation therewith. At least a first water flow passage is provided in the nozzle body. The first flow passage has a longitudinal axis and comprises an inlet, an outlet, and a diffuser connecting the inlet and the outlet. The diffuser has a cross-sectional area that is larger than the cross-sectional area of the inlet. In addition, an impact surface is inclined relative to a longitudinal axis of the flow passage. The impact surface is positioned to intercept a portion of the water flowing in a boundary layer of the diffuser while the water flowing in a non-boundary layer portion is not intercepted by the impact surface.

Another aspect of this invention relates to a nozzle for a rotary sprinkler of the type having a nozzle base that is rotated by a drive. The nozzle comprises a nozzle body configured to be carried by the nozzle base for rotation therewith, the nozzle body having upper and lower water flow passages extending through the nozzle body. The upper passage comprises a substantially cylindrical bore extending through the nozzle body between an inlet and an outlet thereof. The lower passage comprises an inlet, a diffuser adjacent the inlet and having an expanded volume relative to the inlet to reduce the energy of the water passing through the diffuser from the inlet, and an outlet adjacent the diffuser. The outlet has a rear edge interposed into a portion of the water flowing in a boundary layer in the diffuser such that a portion of the boundary layer flow is intercepted by the rear edge of the outlet.

Yet another aspect of this invention relates to a nozzle for a rotary sprinkler of the type having a nozzle base that is rotated by a drive. The nozzle comprises a nozzle body configured to be carried by the nozzle base for rotation therewith. The nozzle includes at least a first water flow passage provided in the nozzle body. The first flow passage has a longitudinal axis and includes an inlet and an outlet. The outlet comprises an upper arch overlying a lower ramp. The lower ramp is downwardly inclined relative to the longitudinal axis passing through the lower passage. The lower ramp has sides which are undercut into the nozzle body relative to the upper arch such that the lower ramp is wider than the upper arch.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

This invention relates to a nozzle 2 for use with a rotary sprinkler 4. More particularly, this invention related to a nozzle 2 that throws a stream of water to one side of sprinkler 4. Thus, as sprinkler 4 rotates, the water stream thrown by nozzle 2 traverses or sweeps over the ground to water a pie-shaped or circular pattern. The angular extent of the pattern being watered by nozzle 2 depends on the amount of angular rotation of sprinkler 4. If sprinkler 4 rotates through 360 degrees, then the watered pattern comprises a circle. If sprinkler 4 oscillates back and forth through 180 degrees, then the watered pattern comprises a half circle.

Figure 11:
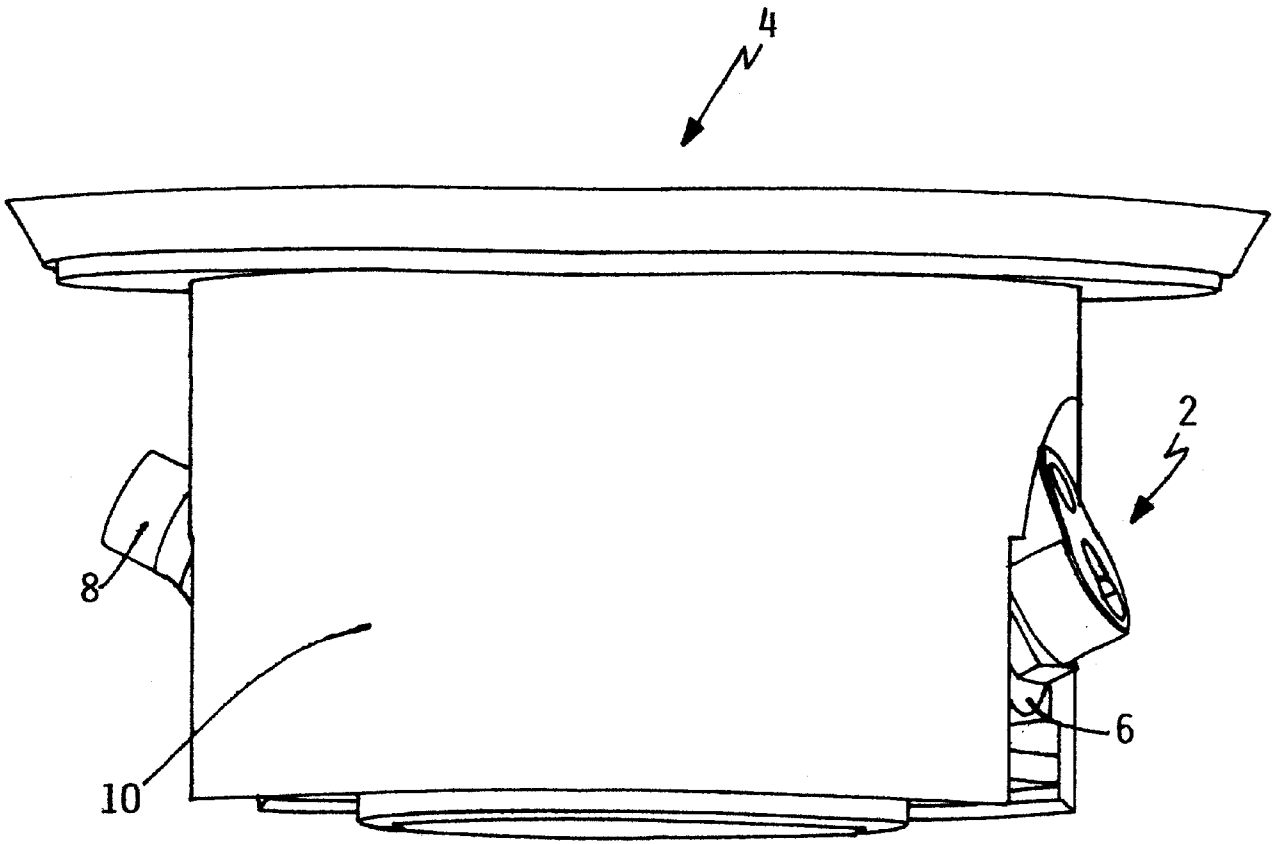
FIG. 11 is a partial, cross-sectional view of the nozzle base of a riser of a pop-up rotary sprinkler in which either of the nozzles shown in FIGS. 1–5 or 6–10 can be installed, with FIG. 11 having the nozzle shown in FIGS. 1–5 for illustrative purposes only and with FIG. 11 also having a second long range nozzle of conventional design installed therein.

FIG. 11 shows a portion of a rotary sprinkler 4 in which nozzle 2 of this invention is installed. Nozzle 2 is installed in a cavity or seat 6 provided in one side of sprinkler 4. When so installed, nozzle 2 is preferably inclined upwardly relative to the surface to be watered so that the stream of water being thrown by nozzle 2 will have some angle of trajectory relative to the surface to be watered. Nozzle 2 can be used by itself as the only nozzle for sprinkler 4. Alternatively, as shown in FIG. 11, nozzle 2 can be used in concert with a second nozzle 8. In this case, second nozzle 8 is arranged for longer range watering, namely for watering radially outer portions of the pattern, while nozzle 2 of this invention is arranged for shorter range watering, namely for watering radially inner and intermediate portions of the pattern.

There are many types of rotary sprinklers 4 on the market, and nozzle 2 of this invention may be used with any of them. A suitable rotary sprinkler 4 will have some type of drive (not shown), such as a ball drive, an impact drive, a water turbine driven gear drive, an electric motor drive, etc., that rotates sprinkler 4 about a rotational axis that is vertical when sprinkler 4 is installed in or on the ground. The drive may be configured to provide full circle or part circle rotation or both. If part circle rotation is provided, the size of the part circle, namely the size of the pie-shaped arc segment being watered by sprinkler 4, can be adjustable using various adjustments known in the art. The drive can be configured to provide continuous or intermittent rotation.

Sprinkler 4 can be mounted permanently above the ground. Alternatively, sprinkler 4 may comprise a pop-up type sprinkler. For example, the portion of sprinkler 4 shown in FIG. 11 comprises the rotatable nozzle base 10 of the riser of a pop-up sprinkler. When water is applied to sprinkler 4 under pressure, the riser pops-up out of the sprinkler body, the sprinkler body being buried in the ground. The top portion of the riser forms nozzle base 10 and carries whatever nozzles are used on sprinkler 4. The drive of sprinkler 4 rotates nozzle base 10 relative to the other non-rotatable portions of sprinkler 4 during operation of sprinkler 4.

Accordingly, the details of sprinkler 4 with which nozzle 2 of this invention is used are not important to this invention, except for the fact that nozzle 2 is preferably used on the rotating portion of a rotary sprinkler 4 as opposed to a fixed spray sprinkler that does not rotate during operation of sprinkler 4.

Referring now to FIGS. 1–5, a first embodiment of the nozzle according to this invention is illustrated generally as 2. Nozzle 2 comprises a nozzle body 12 that is generally cylindrically shaped to allow nozzle body 12 to be press fit into a cylindrically shaped nozzle seat 6 on nozzle base 10 (FIG. 11). Obviously, both the shape of nozzle body 12 and its mating seat 6 could be changed from a cylindrical form to some other form, namely a hexagonal form, etc. Alternatively, nozzle body 12 could be attached or secured to nozzle base 10 in some fashion other than by being press fit into a nozzle seat 6 having a mating shape. For example, nozzle body 12 could be clamped or glued in place on nozzle body 12. In addition, nozzle body 12 could simply be an integral portion of the peripheral sidewall of nozzle base 10, though it is usually preferable that nozzle body 12 be removable from nozzle base 10 to allow nozzle 2 to be cleaned and/or replaced. Accordingly, the exterior configuration of nozzle body 12 and how nozzle body 12 is attached to sprinkler 4 is also not important to this invention.

Nozzle body 12 includes two nozzle passages, an upper passage 14 and a lower passage 16, for permitting water flow through nozzle body 12. The adjectives "upper" and "lower" used to refer to passages 14 and 16, respectively, describes the relative locations of the passages after nozzle 2 is installed in sprinkler 4, i.e. upper passage 14 is above lower passage 16. Lower passage 16 waters those portions of the pattern closest to sprinkler 4. Upper passage 14 waters those portions of the pattern that are radially further out from sprinkler 4.

If nozzle 2 is used on nozzle base 10 in concert with a second, long range nozzle 8 as shown in FIG. 11, then upper passage 14 will water radially intermediate portions of the pattern, i.e. those portions of the pattern lying between those reached by lower passage 16 and those reached by the second, long range nozzle 8. If nozzle 2 is used alone on nozzle base 10 without having a second, long range nozzle 8 be present on nozzle base 10, then upper passage 14 will water some radially intermediate portions of the pattern as well as the radially outer portions of the pattern, with lower passage 16 watering the radially inner portions of the pattern and some radially intermediate portions of the pattern.

Upper passage 14 extends in a straight path between an inlet 18 and an outlet 20. Basically, upper passage 14 is a substantially cylindrical bore having a substantially constant diameter extending longitudinally through nozzle body 12. A plurality of stream straightening vanes 22 are located in a forward portion of upper passage 14 adjacent outlet 20. Three such stream straightening vanes 22, spaced apart by 120°, are preferably used, though the number and spacing of vanes 22 can be varied.

Lower passage 16 has a configuration that is more complex than that of upper passage 14. Lower passage 16 includes a relatively short, cylindrical inlet 24 followed by a longer cylindrical diffuser 26 having a diameter that is greater than the diameter of inlet 24. In turn, diffuser 26 is followed by an outlet 28 which is shaped and sized differently from diffuser 26. Together, inlet 24, diffuser 26 and outlet 28 of lower passage 16 form a single, continuous lower passage extending longitudinally through nozzle body 12. A longitudinal axis $c_1$ through lower passage 16 is parallel to a longitudinal axis $c_u$ of upper passage 14.

Outlet 28 of lower passage 16 comprises an upper arch 30 overlying a lower ramp 32. See FIG. 1. Lower ramp 32 is defined by an upwardly facing, arcuate, trough-shaped surface. Lower ramp 32 inclines downwardly relative to the longitudinal axis $c_l$ of lower passage 16 as one proceeds forwardly. In addition, the sides of lower ramp 32 are undercut into nozzle body 12 relative to upper arch 30 such that lower ramp 32 extends laterally beneath each of the lower ends 36 of the legs of upper arch 30. See FIG. 3 for an illustration of this undercut denoted by the surface 34.

Upper arch 30 in outlet 28 is sized and arranged relative to diffuser 26 to present a rearwardly facing impact surface 38 to the water flowing through diffuser 26. Impact surface 38 is essentially the rear edge of upper arch 30 and, accordingly, has the same arch-shaped configuration as upper arch 30. See FIG. 5. In addition, impact surface 38 is not perpendicular to the longitudinal axis $c_l$ through lower passage 16, but is instead inclined forwardly relative to the centerline $c_l$ from the top to the bottom of impact surface 38. In other words, each lower end 36 of impact surface 38 is located forwardly of the top 40 of impact surface 38 measured along the longitudinal axis $c_l$ of lower passage 16 in the direction of water flow through lower passage 16. See FIGS. 2 and 3. The lower ends 36 of impact surface 38 each terminate above the rear of lower ramp 32.

When water under pressure is applied to the interior of rotary sprinkler 4 in which nozzle 2 is installed, such water will be ported through sprinkler 4 to arrive adjacent inlets 18 and 24 to the upper and lower passages 14 and 16. The water will then flow through inlets 18 and 24 to both passages, through the passages themselves, and will then exit from outlets 20 and 28 to the passages. The water exiting from upper passage 14 will be thrown the farthest. The water exiting from lower passage 16 will water closer to sprinkler 4.

In particular, lower passage 16 is quite effective in watering close to sprinkler 4 while discharging the water substantially in droplet form, even when the water flowing through nozzle 2 is at medium to high pressure, i.e. above 50 psi. The Applicants believe this is due primarily to the use of diffuser 26 and inclined impact surface 38 presented by the rear edge of upper arch 30 of outlet 28. Diffuser 26 is thought to first reduce the energy of the water passing through inlet 24 by giving such water an expanded space or volume to fill. In addition, it is further thought that impact surface 38 redirects the water flowing in the upper portion of the boundary layer around to the lower portion of the boundary layer and then dumps this boundary layer water onto lower ramp 32 of outlet 28. The remaining portions of the water flow, i.e. the non-boundary layer water, pass straight out through upper arch 30 of outlet 28.

The reference to boundary layer flow in this application means the water which flows in a layer immediately adjacent the walls or surfaces that confine the flow. Thus, for water flowing in a circular pipe or passage, such as the water flowing through diffuser 26 prior to its engagement with impact surface 38, the boundary layer flow will comprise an annular layer of water immediately adjacent the cylindrical wall forming diffuser 26 with the non-boundary layer flow comprising the rest of the water stream radially inside the annular boundary layer.

As noted earlier, impact surface 38 is longitudinally inclined relative to the longitudinal axis $c_l$ of lower passage 16. In addition, impact surface 38 is twisted across the radial width of impact surface 38 in a progressive manner between the top 40 of impact surface 38 and each lower end 36 thereof. This will be explained by reference to FIG. 12.

Figure 12:
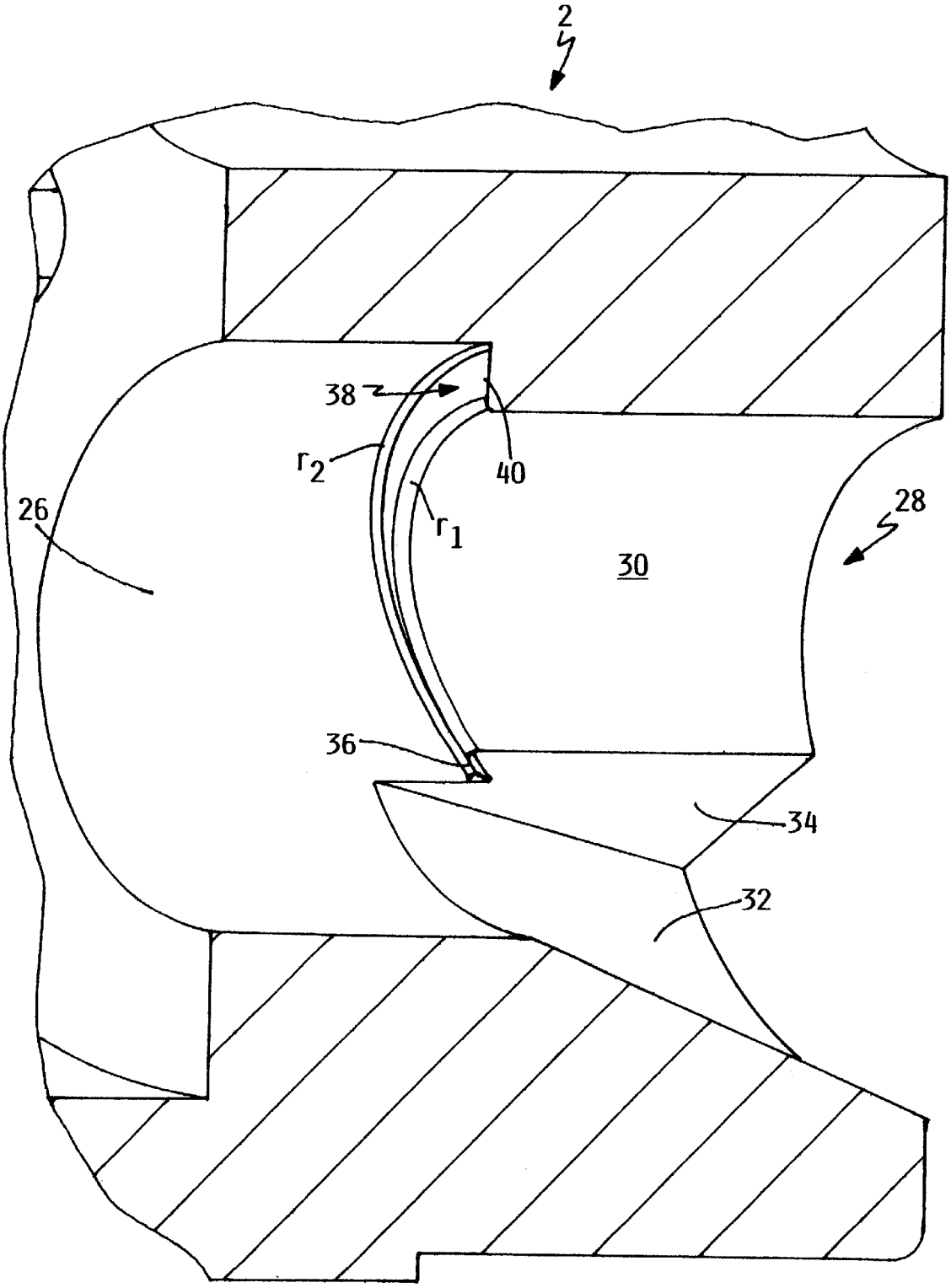
FIG. 12 is an enlarged perspective view of a portion of the nozzle shown in FIG. 1, particularly illustrating the impact surface in the lower passage and the lateral twisting of that surface between the top of the surface and the lower ends of the surface.

As shown in FIG. 12, one side of impact surface 38 blends into upper arch 30 via a first convex rounded surface $r_1$. The other side of impact surface 38 blends into diffuser 26 via a second concave rounded surface $r_2$. Concave rounded surface $r_2$ forms, in effect, a shallow trough at the junction between impact surface 38 and the cylindrical wall defining diffuser 26.

At the top 40 of impact surface 38, impact surface 38 extends generally perpendicularly relative to the incoming water flow. However, as impact surface 38 moves from the top 40 thereof towards each lower end 36, impact surface 38 twists across the radial width of surface 38 with the junction between impact surface 38 and the first rounded surface $r_1$ moving rearwardly relative to the junction between impact surface 38 and the second rounded surface $r_2$. Thus, along any radial line through impact surface 38, the radial line being taken from the centerline of upper arch 30, the impact surface 38 will be tilted or pointed towards the trough formed by concave second rounded surface $r_2$. As noted earlier, at the top 40 of impact surface 38, the amount of this tilt will be zero or quite negligible. As one proceeds from the top 40 of impact surface to each lower end, the amount of this tilt gradually increases to a maximum tilt adjacent each lower end 36.

Thus, incoming water hitting impact surface 38 will, by virtue of the radial tilt in surface 38, be directed laterally towards the shallow trough formed by second rounded surface $r_2$. This redirection is least at the top 40 of impact surface 38 where the impact surface is more or less perpendicular across its radial width relative to the incoming water flow. However, the redirection increases from the top 40 towards each lower end 36 since the impact surface 38 begins to be more and more twisted relative to the incoming water flow. This twist in impact surface 38 relative to the radial width of impact surface 38, in addition to the longitudinal inclination of impact surface 38, is thought to contribute to the effective redirection of the upper portion of the boundary layer flow around the impact surface 38 and the discharge of this redirected portion of the boundary layer flow where the lower ends 36 of impact surface 38 break though undercut 34 and discharge onto lower ramp 32.

While the radial twist in impact surface 38 is thought to be desirable, it could be eliminated. In this case, impact surface 38 would have a relatively constant orientation relative to the first and second rounded surfaces $r_1$ and $r_2$ as one proceeds from the top 40 to each lower end 36 of impact surface 38.

Thus, the lower water passage 16 is first thought to lower the energy of the water in the water stream through use of diffuser 26 and to then further lower the energy of the boundary layer water only via the use of inclined impact surface 38. In addition, inclined impact surface 38 tends also to redirect most of the upper portion of the boundary layer water so that most of the boundary layer water gets discharged beneath the non-boundary layer water that was not directed against impact surface 38.

The net result is that water flowing through outlet 28 of lower passage 16 is very effective at watering close to sprinkler 4 without breaking the water up into a mist or spray. Instead, water will precipitate or fall out of the stream passing out of lower passage 16 substantially in droplet form. As such, this water is less susceptible to being blown away by any wind that might be present. According, the water will be more evenly distributed from radially inner to radially outer portions of the pattern.

This result has been observed by the Applicants and is true of the structure of lower passage 16 shown herein even if the theory of operation set forth herein by the Applicants, including the effects of lower passage 16 on the boundary layer water, is not correct. The Applicants have set forth herein why they think lower passage 16 is effective in achieving distribution of droplets, as opposed to a mist or spray, but do not wish to be bound by this explanation in case some other explanation or theory, as yet unknown to the Applicants, is the reason for the laudable performance of lower passage 16. The Applicants are simply aware that lower passage 16 shown herein does distribute water relatively close to sprinkler 4 in substantially droplet form at relatively medium to high water pressures, i.e. at 50 psi or above.

Water is, of course, also being discharged by upper passage 14. However, since upper passage 14 is a simple, straight cylindrical bore, of somewhat smaller cross-sectional area than lower passage 16, and further includes the use of stream straightening vanes 22, the portion of the water stream formed by the water from upper passage 14 will travel further than the portion of the water stream ejected from lower passage 16. This is also enhanced by placing upper passage 14 above lower passage 16. Thus, the combined effect of the water thrown from both the upper and lower passages 14 and 16 is to water radially outwardly from sprinkler 4 with relatively uniform distribution, all in substantially droplet form, from close to sprinkler 4 to far from sprinkler 4. The radially inner portions of this pattern are covered by the water from lower passage 16 while the radially outer portions of this pattern are covered by the water from upper passage 14.

As noted earlier, nozzle 2 of this invention can be employed in conjunction with another nozzle 8 designed for even farther throw. In this case, the upper and lower passages 14 and 16 will be sized to water the radially inner and intermediate portions of the pattern while leaving radially farther portions of the pattern to the other nozzle 8. However, if nozzle 2 of this invention is used by itself on a rotary sprinkler 4, then the upper and lower passages 14 and 16 will be sized to water the entire pattern themselves, with lower passage 16 covering the radially inner and some intermediate portions of the pattern and upper passage 14 covering the radially farther portions of the pattern.

While nozzle 2 of this invention preferably uses both the upper and lower passages together, upper passage 14 could be deleted in which case nozzle 2 of this invention would have only lower passage 16. In this event, coverage of radially outer portions of the pattern would be left to other nozzles.

It is believed by the Applicants that the use of lower ramp 32 of outlet 28 of lower passage 16 contributes to achieving close-in distribution of water since the boundary layer water is deposited onto the downwardly inclined surface of ramp 32 to be directed or pointed closer to the base of sprinkler 4. However, the Applicants also believe that lower passage 16 would be also quite effective at achieving close-in water distribution in substantially droplet form even if lower ramp 32 were not downwardly inclined relative to the longitudinal axis $c_l$ of lower passage 16.

Nozzle 2 is preferably molded from plastic. To facilitate injection molding of nozzle 2, nozzle 2 is preferably molded from two parts 42 and 44 which are subsequently and permanently affixed together, e.g. by a press fit or the like. The first part 42 comprises the outer periphery of nozzle 2 as well as outlets 20 and 28 of the upper and lower passages 14 and 16. The second part 44 comprises an insert containing inlets 18 and 24 of the upper and lower passages as well as a portion of upper passage 14 and a portion of diffuser 26 of lower passage 16. The first part 42 can comprise inwardly extending guide ribs 46 (See FIG. 5) for coacting with the periphery of the second part 44 to allow the second part 44 to be guided into and to be telescopically received within the first part 42.

Forming nozzle 2 in the two parts 42 and 44 shown herein allows simplified and less expensive molding. More specifically, the mold cores can be removed easily from the two separate parts 42 and 44 with these parts then being subsequently joined together as described above. However, nozzle 2 could be made of materials other than plastic and other manufacturing methods could be used to form nozzle 2.

A second embodiment of a nozzle according to this invention is shown in FIGS. 6–10 and is illustrated generally as 2'. Various components of nozzle 2' are similar to components of nozzle 2. Accordingly, those components in nozzle 2' which are the same as or correspond to components in nozzle 2 will be referred to using the same reference numerals as for those components in the first embodiment, except that the reference numerals for the second embodiment will be followed by a prime suffix. Thus, nozzle 2 of the second embodiment will be referred to as 2' instead of 2, upper passage 14 will be referred to as 14' instead of 14, etc. Nozzle 2' of the second embodiment will be described by describing the differences between it and nozzle 2 of the first embodiment.

Figure 8:
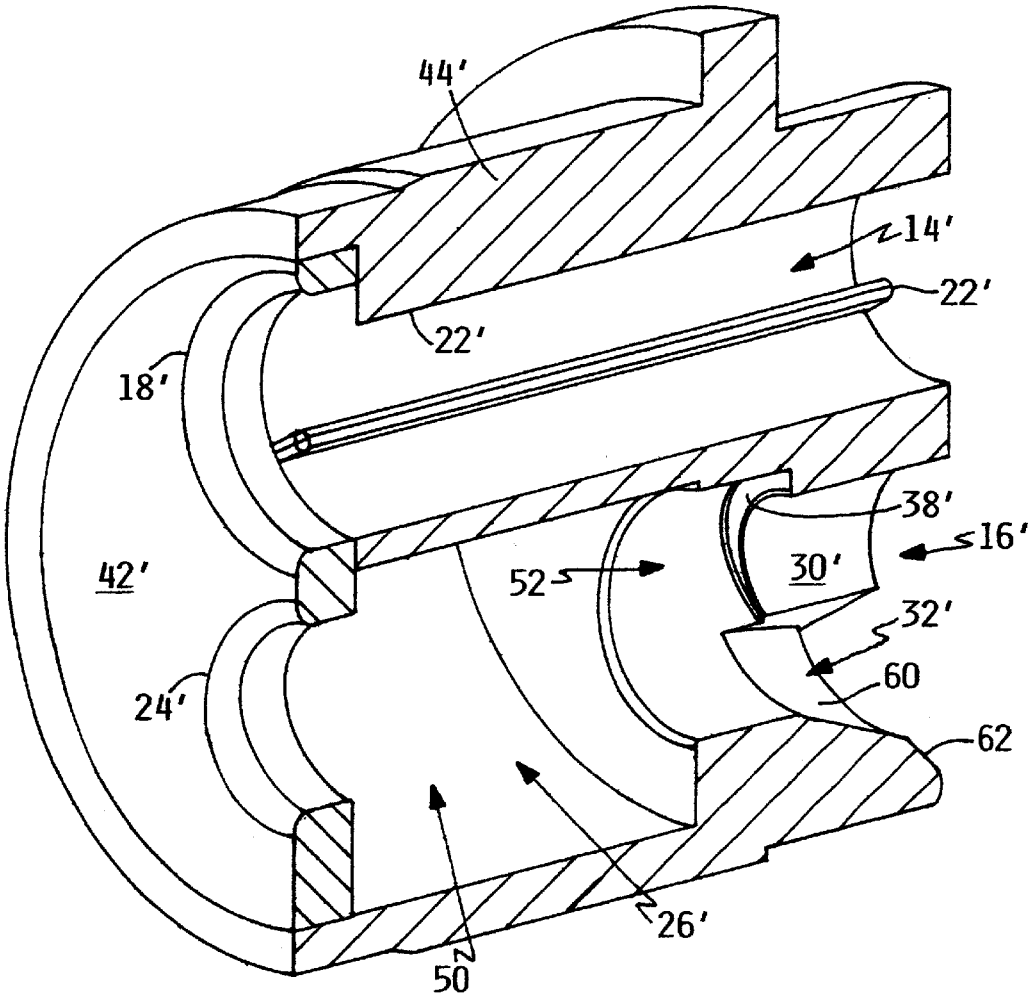
FIG. 8 is a longitudinal, cross-sectional view of the nozzle shown in FIG. 6, similar to that of FIG. 7, but with the view of FIG. 8 having been rotated to be shown in perspective to better illustrate the inclined impact surface for the lower passage of the nozzle.
Figure 9:
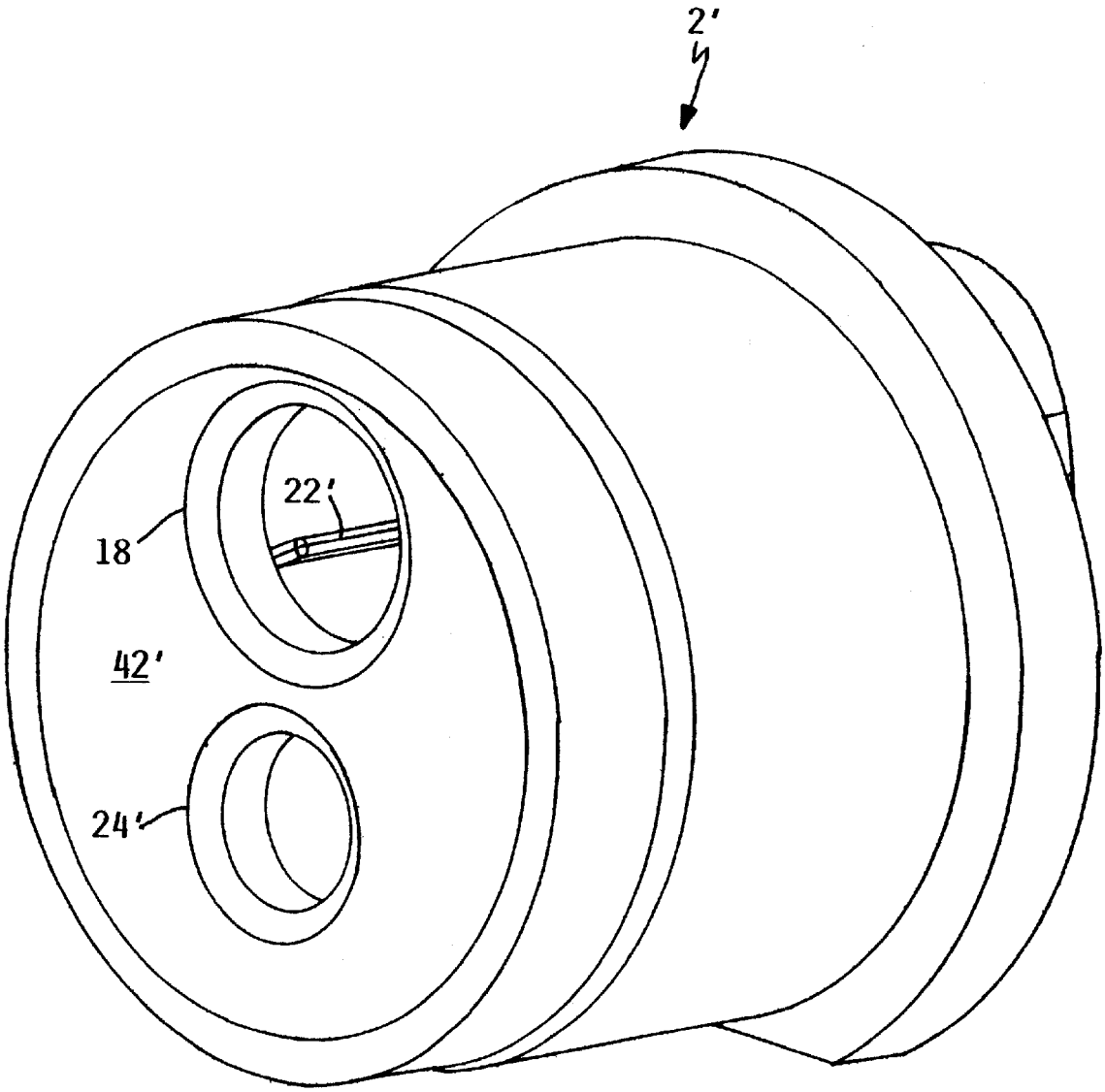
FIG. 9 is a perspective view of the nozzle shown in FIG. 6, particularly illustrating the inlets of the upper and lower passages of the nozzle.
Figure 10:
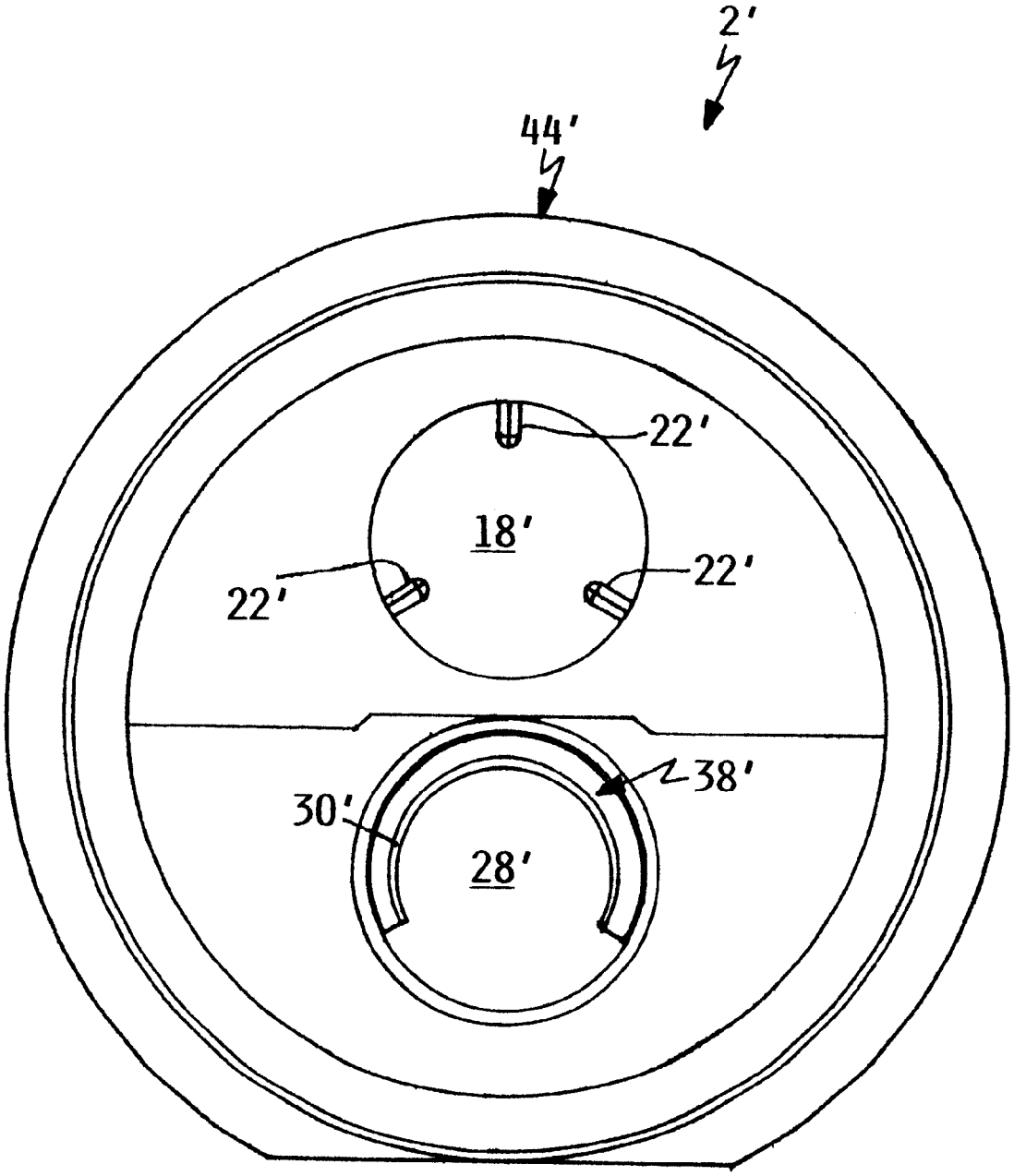
FIG. 10 is a rear view of a portion of the nozzle shown in FIG. 6, particularly illustrating the outlets of the upper and lower passages of the nozzle by looking at the rear of the outlets.

Referring now to FIGS. 6–10, nozzle 2' has been designed to discharge water at water pressures even higher than that of nozzle 2, e.g. at 80 psi instead of 50 psi. In nozzle 2', diffuser 26' now has a much larger volume and a more complex shape, to thereby lower the energy in the water flow even more. Referring to FIG. 8, diffuser 26' now comprises a relatively long, large rear cavity 50 that is semi-cylindrical in form with the center of the cylinder being located approximately on the centerline of the entire nozzle and not simply on the centerline of lower passage 16. In addition, diffuser 26' comprises a relatively short, front cavity 52 formed as a cylindrical bore. This front cavity 52 of diffuser 26' adjoins outlet 28', and the inclined impact surface 38' of upper arch 30' in much the same way as in nozzle 2.

Figure 1:
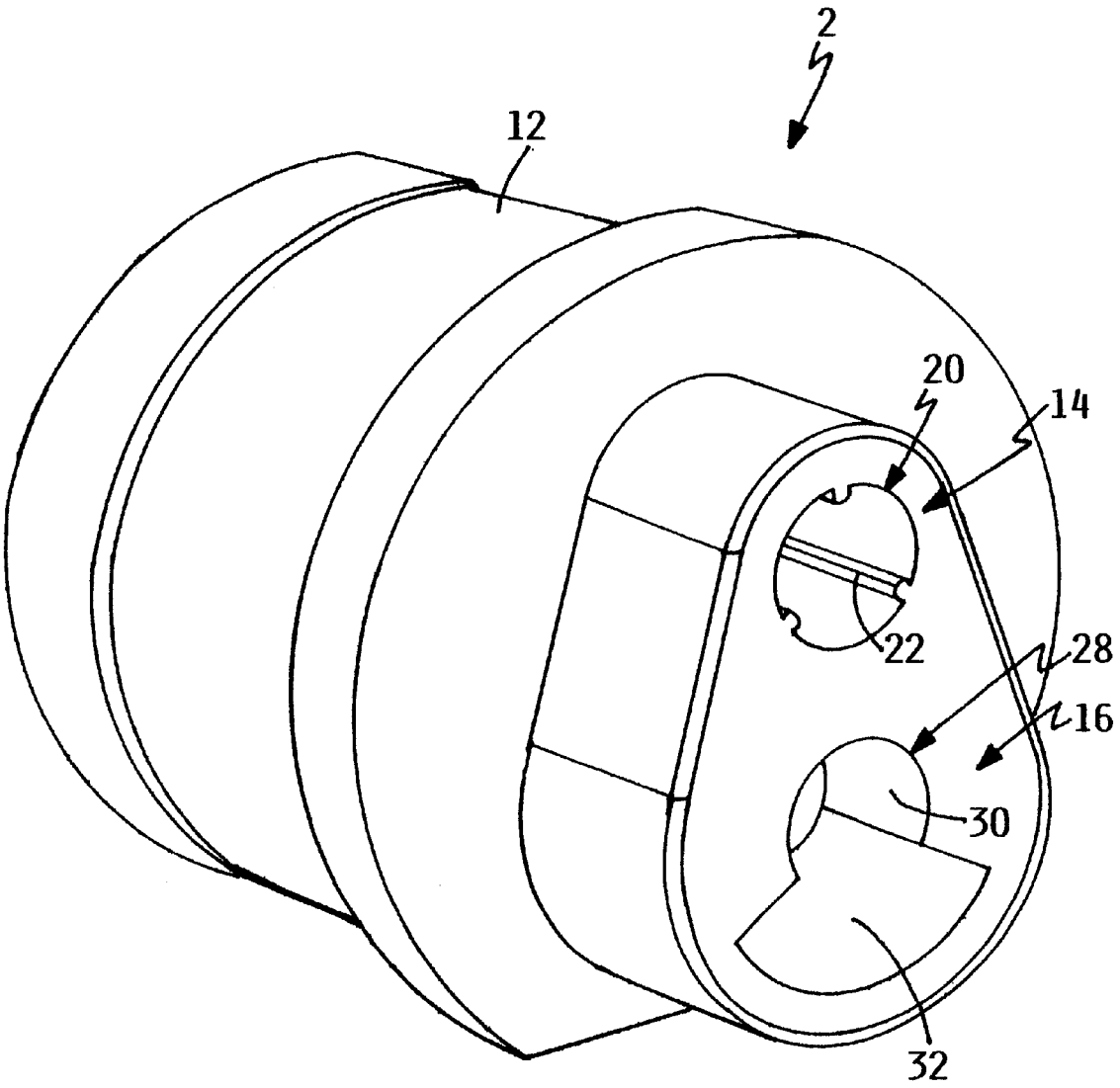
FIG. 1 is a perspective view of a first embodiment of a nozzle according to this invention, particularly illustrating the outlets of the upper and lower passages of the nozzle.
Figure 2:
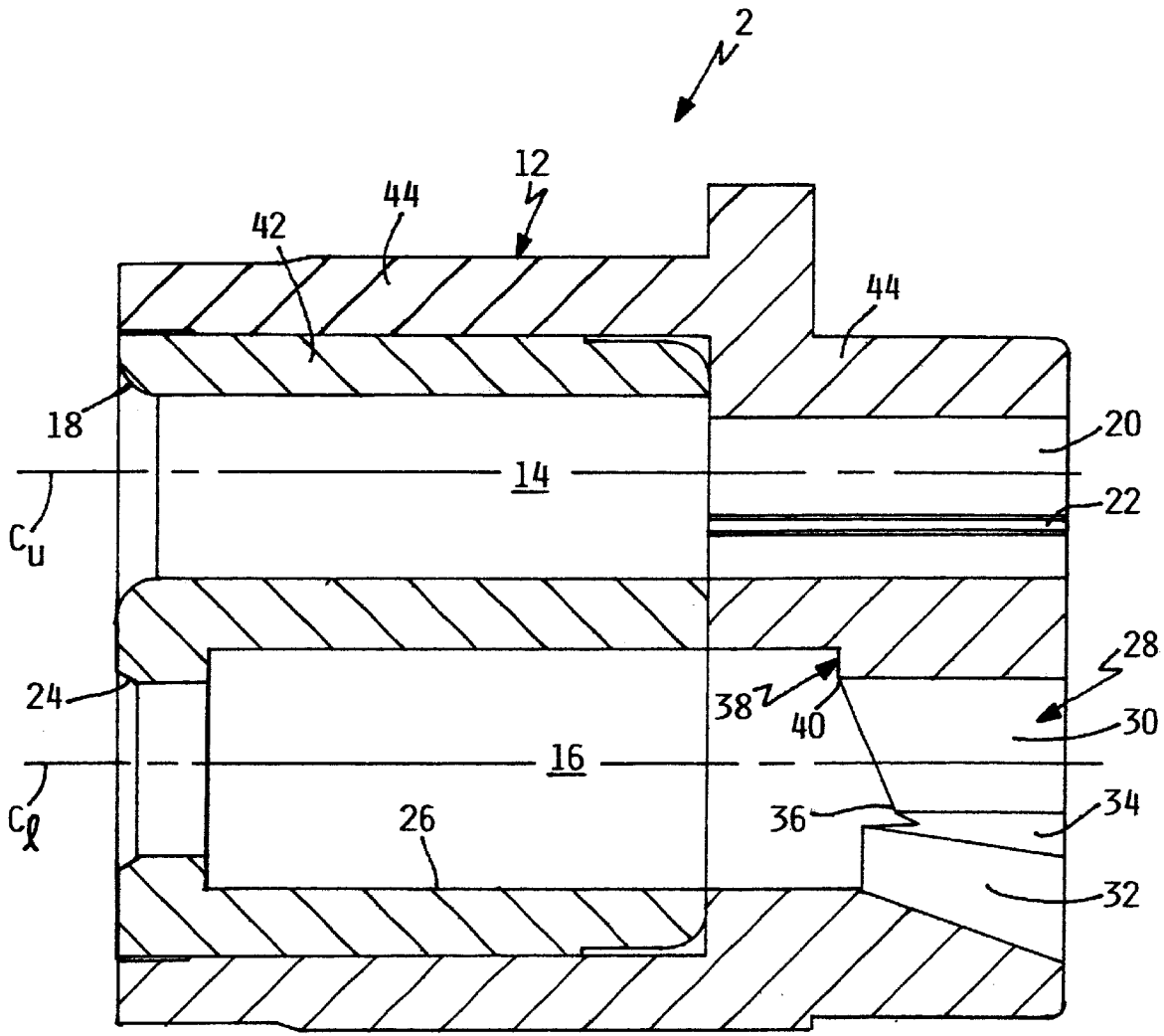
FIG. 2 is a longitudinal, cross-sectional view of the nozzle shown in FIG. 1.
Figure 3:
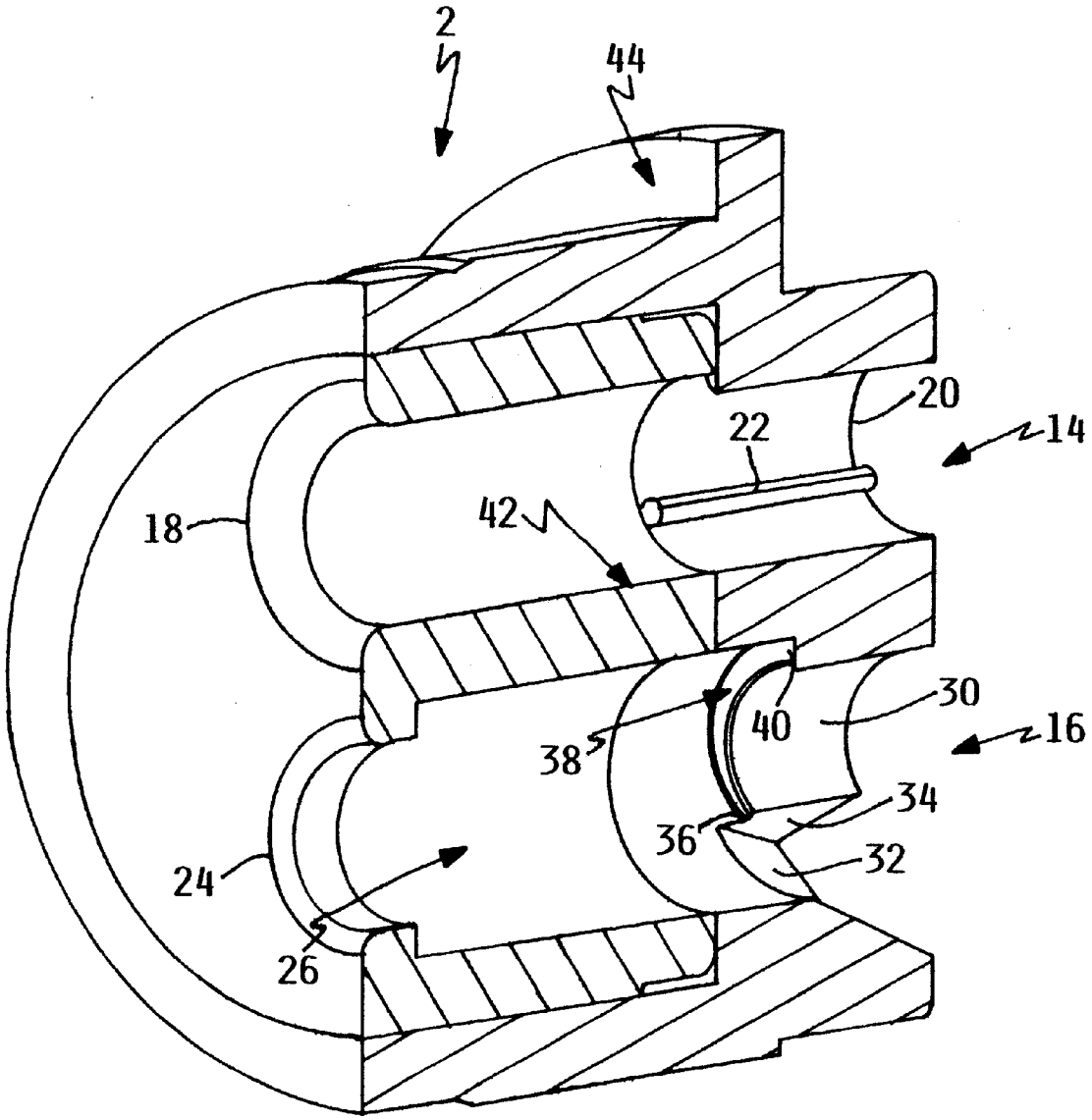
FIG. 3 is a longitudinal, cross-sectional view of the nozzle shown in FIG. 1, similar to that of FIG. 2, but with the view of FIG. 3 having been rotated to be shown in perspective to better illustrate the inclined impact surface in the lower passage of the nozzle.
Figure 4:
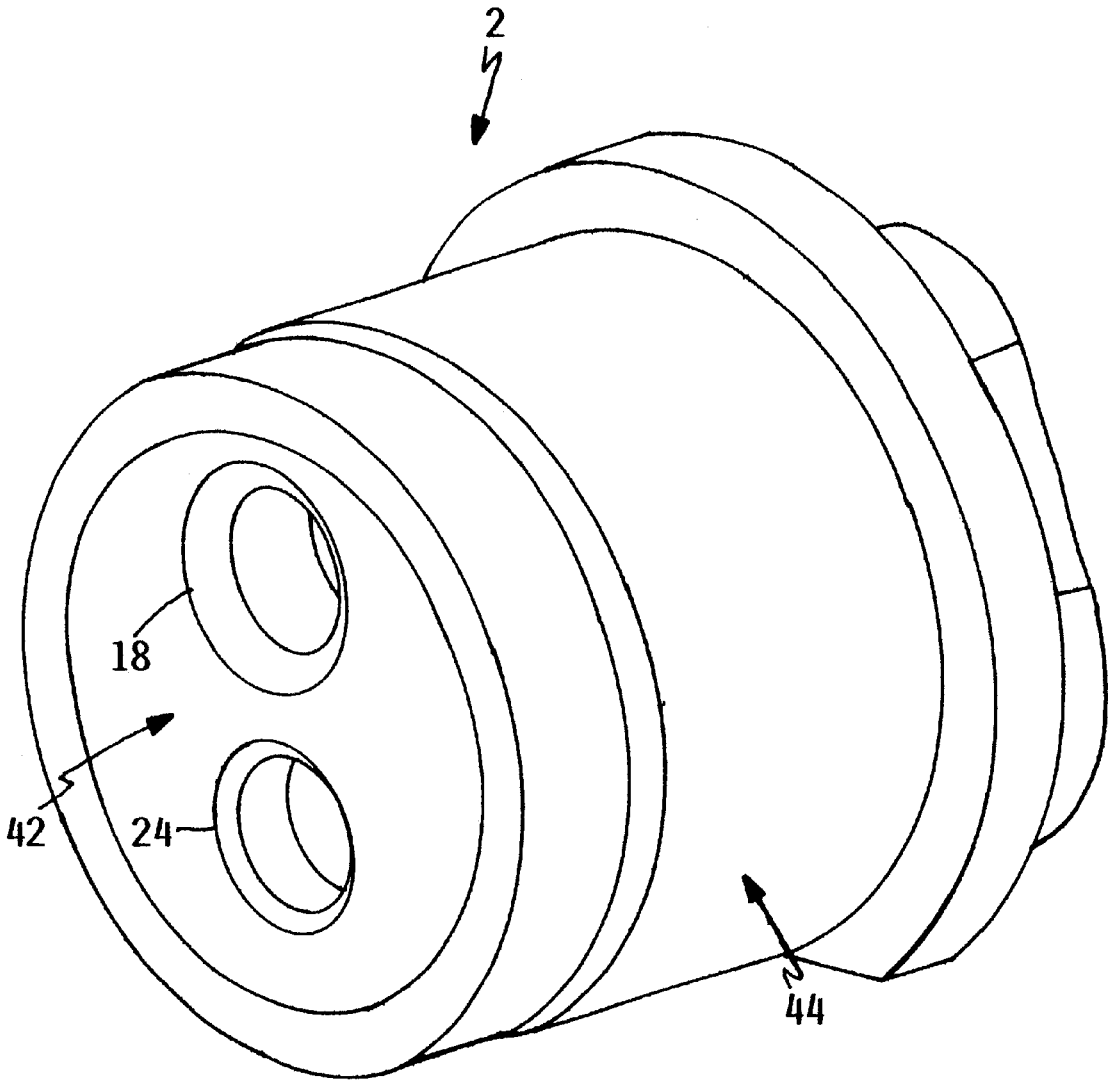
FIG. 4 is a perspective view of the nozzle shown in FIG. 1, particularly illustrating the inlets of the upper and lower passages of the nozzle.
Figure 5:
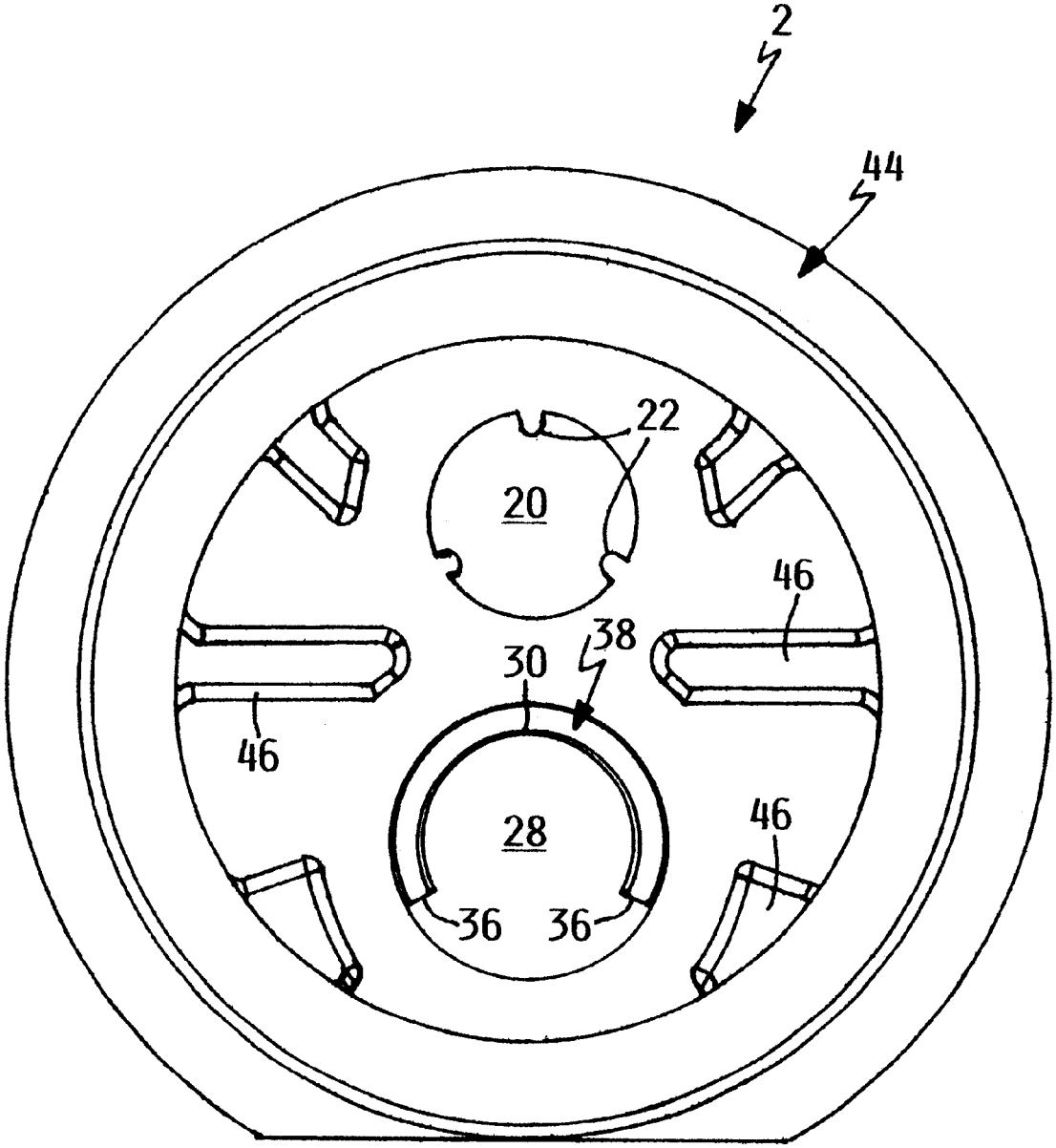
FIG. 5 is a rear view of a portion of the nozzle shown in FIG. 1, particularly illustrating the outlets of the upper and lower passages of the nozzle by looking at the rear of the outlets.
Figure 6:
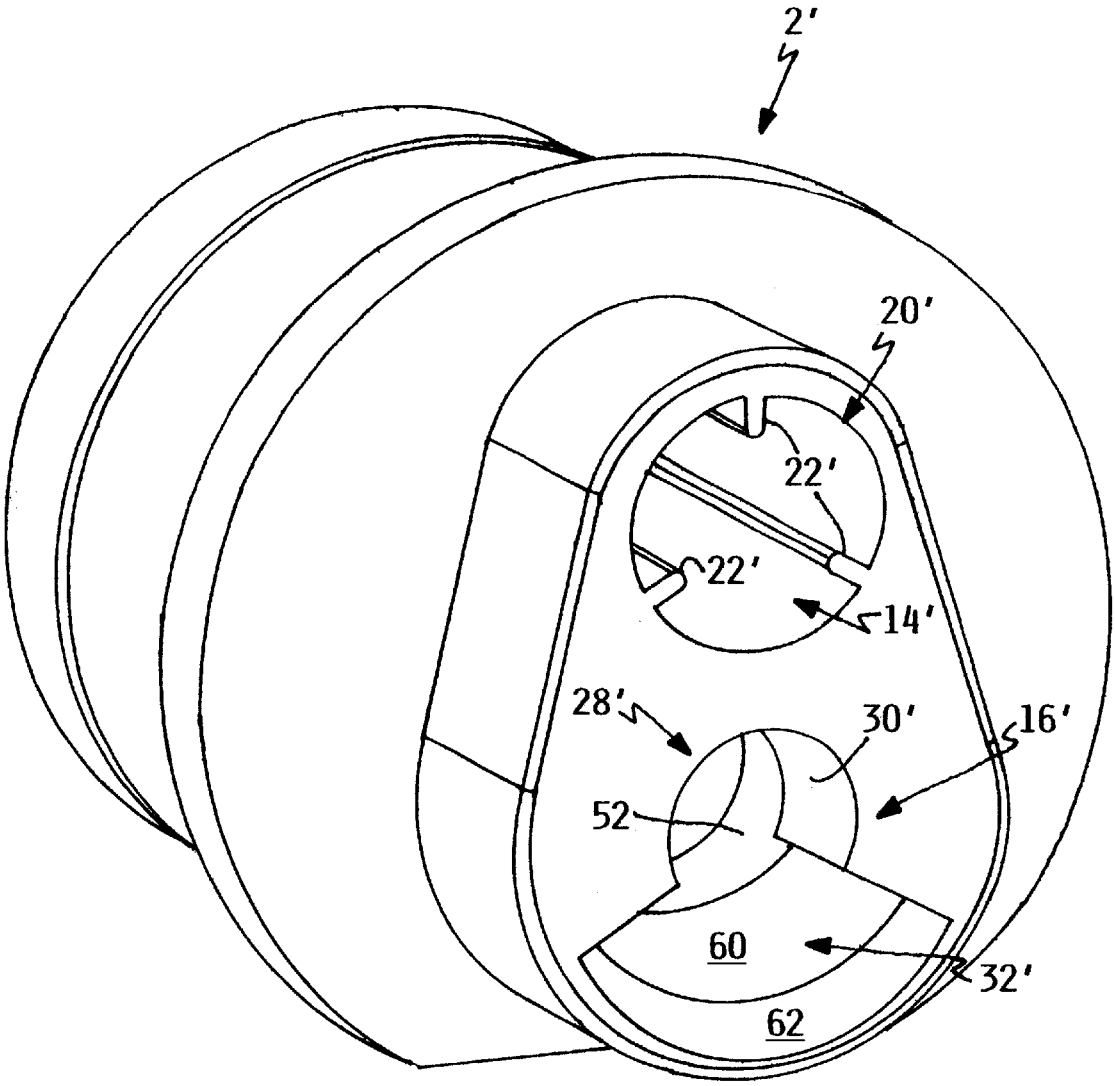
FIG. 6 is a perspective view of a second embodiment of a nozzle according to this invention, particularly illustrating the outlets of the upper and lower passages of the nozzle.
Figure 7:
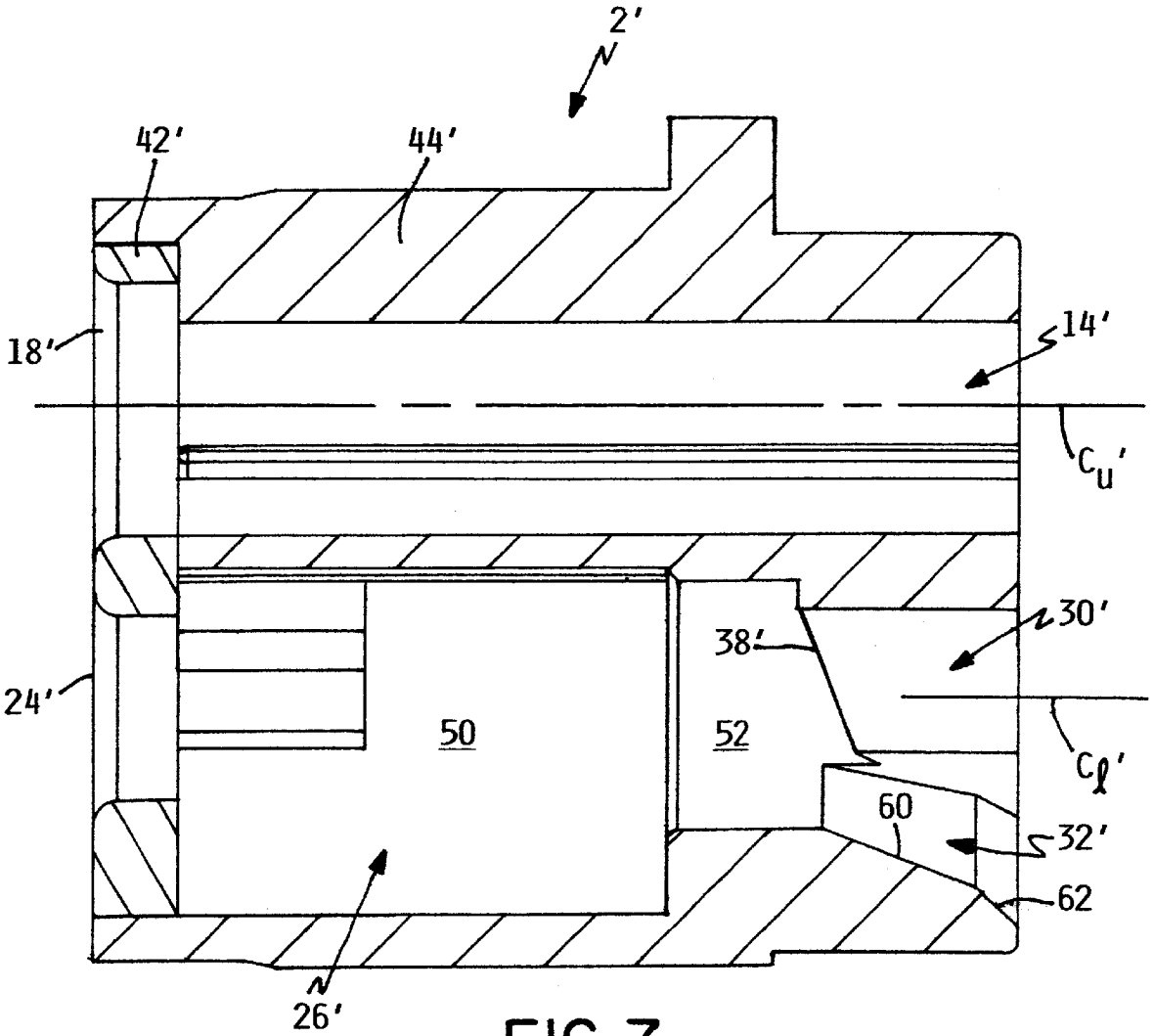
FIG. 7 is a longitudinal, cross-sectional view of the nozzle shown in FIG. 6.

Rear cavity 50 of diffuser 26' provides a much larger volume than the cylindrical diffuser 26 in nozzle 2 of the first embodiment. Compare FIG. 8 with FIG. 3. FIG. 8 shows the large semi-cylinder forming the rear cavity 50 of diffuser 26' while FIG. 3 shows the much smaller cylindrical bore of diffuser 26. Effectively, diffuser 26' in FIG. 8 utilizes much more of the space or volume of nozzle 2' all the way to the sidewall of nozzle 2', which space or volume is obstructed in nozzle 2 by some of the guide ribs 46. In nozzle 2', there are no such guide ribs 46 and the insert 44' is only a flat plate carrying inlets 18' and 24'. Accordingly, the larger volume of diffuser 26' in nozzle 2' means an increased expansion of the water flow, and thus an increased lowering of the energy of the water, compared to diffuser 26 in nozzle 2. This is appropriate since the higher water pressure, i.e. 80 psi, with which nozzle 2 is intended to be used necessarily requires that more energy needs to be lost for the water to still be discharged in substantially droplet form.

Another difference between nozzles 2 and 2' is the use of a lower ramp 32' formed in two sections with different angles of inclinations. Lower ramp 32' now has a rear portion 60 which is downwardly inclined relative to the longitudinal axis $c_l'$ of lower passage 16' at a first angle. In addition, lower ramp 32' also has a front portion 62 which is downwardly inclined relative to the longitudinal axis $c_l'$ of lower passage 16' at a second angle which is larger than the first angle. This dual section lower ramp 32' has been found useful in nozzle 2' in achieving water distribution close to sprinkler 4.

Nozzle 2' also uses stream straightening vanes 22' in upper passage 14' extending the full length of that passage. This ensures that the water flowing out of upper passage 14' extends to the full reach intended for nozzle 2'.

Nozzle 2' of the second embodiment still provides the same advantages as nozzle 2 of the first embodiment, i.e. an ability to water close to sprinkler 4 in substantially droplet form, thereby increasing the uniformity of the water distribution from close to sprinkler 4 to areas radially far from sprinkler 4. Nozzle 2' is simply configured for even higher water pressures than nozzle 2 of the first embodiment.

Either of nozzles 2 and 2' of this invention are useful on rotary sprinkler 4 particularly when nozzle 2 or 2' is intended to throw at relatively high water pressures, e.g. at or above approximately 50 psi. However, nozzle 2 or 2' is obviously useful as well at lower water pressures and is still effective in achieving more uniform water distribution in a radial direction extending outwardly from sprinkler 4. It is just that nozzle 2 or 2' is not needed as much at lower water pressures since other nozzles currently known do not tend to convert the water stream to a spray or mist at such lower water pressures.

Various other modifications of this invention will be apparent to those skilled in the art. Thus, the scope of the invention shall be limited only by the appended claims.

We claim:

1. A nozzle for a rotary sprinkler of the type having a nozzle base that is rotated by a drive, which comprises:

(a) a nozzle body configured to be carried by the nozzle base for rotation therewith; and (b) at least a first water flow passage provided in the nozzle body, the first flow passage having a longitudinal axis and comprising:

(i) an inlet;

(ii) an outlet;

(iii) a diffuser connecting the inlet and the outlet, the diffuser having a cross-sectional area that is larger than the cross-sectional area of the inlet; and (iv) an impact surface which is inclined relative to the longitudinal axis of the first flow passage, the impact surface being positioned to intercept a portion of the water flowing in a boundary layer of the diffuser while the water flowing in a non-boundary layer portion is not intercepted by the impact surface.

2. The sprinkler nozzle of claim 1, wherein the impact surface is arch shaped with the non-boundary layer portion of the water passing through the arch shape of the impact surface and the at least a portion of the boundary layer water flow impacting against the arch shape of the impact surface.

3. The sprinkler nozzle of claim 2, wherein the arch shape of the impact surface includes a top which extends between and joins spaced legs, and wherein the arch shape is oriented to face downwardly relative to the first flow passage such that the top is located above a lower end of each leg, and wherein the arch shape of the impact surface is inclined such that the lower end of each arch leg is located forwardly from the top of the arch in the direction the water flows in the first flow passage between the inlet and the outlet.

4. The sprinkler nozzle of claim 3, wherein the outlet comprises an upper arch, and wherein the arch shaped impact surface is a rear edge of the upper arch with such rear edge extending into the boundary layer water flow in the diffuser.

5. The sprinkler nozzle of claim 4, wherein the lower end of each arch leg is located above a lower ramp of the outlet, the lower ramp of the outlet being inclined downwardly relative to the longitudinal axis of the first flow passage.

6. The sprinkler nozzle of claim 5, wherein the lower ramp is formed in at least two different sections having different angles of downward inclination.

7. The sprinkler nozzle of claim 6, wherein the lower ramp comprises a rear portion at a first angle of downward inclination and a forward portion at a second angle of downward inclination, the second angle being larger than the first angle.

8. The sprinkler nozzle of claim 5, wherein the lower ramp is defined by an arcuate, upwardly facing trough.

9. The sprinkler nozzle of claim 5, wherein the lower ramp has sides which are undercut into the nozzle body relative to the upper arch such that the lower ramp is wider than the upper arch.

10. The sprinkler nozzle of claim 9, wherein the lower end of each arch leg is located above a rear portion of the lower ramp.

11. The sprinkler nozzle of claim 1, wherein the first flow passage comprising the inlet, the outlet, the diffuser and the impact surface is only one flow passage in a nozzle body having more than one flow passage.

12. The sprinkler nozzle of claim 11, wherein the nozzle body has a second flow passage with a longitudinal axis that is parallel to the longitudinal axis of the first flow passage.

13. The sprinkler nozzle of claim 12, wherein the second flow passage is located above the first flow passage when the nozzle is carried on the nozzle base of the sprinkler.

14. The sprinkler nozzle of claim 12, wherein the second flow passage includes a substantially cylindrical bore extending through the nozzle body between an inlet and an outlet.

15. The sprinkler nozzle of claim 14, wherein the second flow passage includes a plurality of stream straightening vanes extending along at least a portion of the second flow passage.

16. The sprinkler nozzle of claim 1, wherein the diffuser of the first flow passage comprises a substantially cylindrical bore and the inlet of the first flow passage comprises a substantially cylindrical bore, the substantially cylindrical bore forming the first flow passage having a larger diameter than the substantially cylindrical bore of the second flow passage.

17. The sprinkler nozzle of claim 1, wherein the diffuser of the first flow passage comprises a rear cavity adjacent the inlet of the first flow passage which rear cavity is non-cylindrical in shape, the diffuser further having a front cavity between the rear cavity and the outlet with the front cavity comprising a substantially cylindrical bore.

18. A sprinkler nozzle for a rotary sprinkler of the type having a nozzle base that is rotated by a drive, which comprises:

(a) a nozzle body configured to be carried by the nozzle base for rotation therewith, the nozzle body having upper and lower water flow passages extending through the nozzle body;

(b) wherein the upper passage comprises a substantially cylindrical bore extending through the nozzle body between an inlet and an outlet thereof; and (c) wherein the lower passage comprises:

(i) an inlet;

(ii) a diffuser adjacent the inlet and having an expanded volume relative to the inlet to reduce the energy of the water passing through the diffuser from the inlet; and (iii) an outlet adjacent the diffuser, the outlet having a rear edge that protrudes inwardly relative to a surface of the diffuser immediately upstream of the rear edge such that the rear edge forms an impact surface that extends inwardly into a portion of the water flowing in a boundary layer along the surface of the diffuser such that the portion of the boundary layer flow impacts against the rear edge of the outlet.

19. A sprinkler nozzle for a rotary sprinkler of the type having a nozzle base that is rotated by a drive, which comprises:

(a) a nozzle body configured to be carried by the nozzle base for rotation therewith, the nozzle body having upper and lower water flow passages extending through the nozzle body;

(b) wherein the upper passage comprises a substantially cylindrical bore extending through the nozzle body between an inlet and an outlet thereof; and (c) wherein the lower passage comprises:

(i) an inlet;

(ii) a diffuser adjacent the inlet and having an expanded volume relative to the inlet to reduce the energy of the water passing through the diffuser from the inlet; and (iii) an outlet adjacent the diffuser, the outlet having a rear edge interposed into a portion of the water flowing in a boundary layer in the diffuser such that a portion of the boundary layer flow is intercepted by the rear edge of the outlet, wherein the outlet includes an upper arch with the rear edge of the outlet comprising a rear edge of the upper arch.

20. The sprinkler nozzle of claim 19, wherein the rear edge of the upper arch is inclined relative to a longitudinal axis passing through the lower passage with lower ends of the rear edge being located forwardly of a top of the rear edge in the direction of the water flow through the lower passage.

21. The sprinkler nozzle of claim 19, wherein the outlet further includes a lower ramp, the upper arch of the outlet overlying the lower ramp of the outlet.

22. The sprinkler nozzle of claim 21, wherein the lower ramp is downwardly inclined relative to the longitudinal axis passing through the lower passage.

23. A nozzle for a rotary sprinkler of the type having a nozzle base that is rotated by a drive, which comprises:

(a) a nozzle body configured to be carried by the nozzle base for rotation therewith; and (b) at least a first water flow passage provided in the nozzle body, the first flow passage having a longitudinal axis and comprising:

(i) an inlet;

(ii) an outlet; and (iii) wherein the outlet comprises an upper arch overlying a lower ramp, wherein the lower ramp is downwardly inclined relative to the longitudinal axis passing through the first flow passage, and wherein the lower ramp has sides which are undercut into the nozzle body relative to the upper arch such that the lower ramp is wider than the upper arch.

* * * * *